United States Patent [19]

Koivuranta et al.

[11] Patent Number: 4,917,766

[45] Date of Patent: Apr. 17, 1990

[54] HYBRID FORMER FOR A PAPER MACHINE

[75] Inventors: Mauri Koivuranta, Petäjävesi, Finland; Michael Odell, New Zealand

[73] Assignee: Valmet Paper Machinery Inc., Finland

[21] Appl. No.: 209,493

[22] Filed: Jun. 20, 1988

[30] Foreign Application Priority Data

Jun. 18, 1987 [FI] Finland ..... 872726

[51] Int. Cl.[4] ..... D21F 1/00

[52] U.S. Cl. ..... 162/301; 162/300; 162/352

[58] Field of Search ..... 162/300, 301, 303, 348, 162/352

[56] References Cited

U.S. PATENT DOCUMENTS

| | | | |
|---|---|---|---|
| 3,994,774 | 11/1976 | Halme et al. | 162/301 |
| 4,532,008 | 7/1985 | Creagon et al. | 162/303 |
| 4,557,802 | 10/1985 | Waris et al. | 162/301 |
| 4,609,435 | 9/1986 | Tissari | 162/301 |
| 4,623,429 | 11/1986 | Tissari | 162/301 |

FOREIGN PATENT DOCUMENTS

| | | | |
|---|---|---|---|
| 3138133 | 3/1986 | Fed. Rep. of Germany | 162/301 |
| 177439 | 4/1986 | Japan | 162/348 |
| 1119796 | 6/1986 | Japan | 162/348 |
| 86/04368 | 7/1986 | PCT Int'l Appl. | 162/348 |
| 2143871 | 2/1985 | United Kingdom | 162/348 |

*Primary Examiner*—Karen M. Hastings

*Attorney, Agent, or Firm*—Steinberg & Raskin

[57] ABSTRACT

Hybrid former for a paper machine which has a lower-wire loop forming a single-wire dewatering zone in which water is removed from a web being formed by a dewatering member situated inside the wire loop through the lower wire. The former also has an upper-wire unit which includes an upper-wire loop forming a second twin-wire dewatering zone after the first single-wire dewatering zone, together with a run of the lower wire. The former additionally includes a hollow-faced first forming roll fitted inside the upper-wire loop, at which the second, twin-wire dewatering zone starts, this zone being curved upwardly over a certain sector of this forming roll. A forming shoe is fitted inside the lower-wire loop after the forming roll and guides the second dewatering zone. This forming shoe is provided with a curved deck for guiding the lower-wire loop. Deflector units are fitted both inside the lower-wire loop and inside the upper-wire loop on the twin-wire dewatering zone between the first forming roll and the forming shoe. By way of these deflector units, sufficiently strong impulses improving the formation of a web are produced, which act upon the web that is being formed from both sides thereof.

21 Claims, 3 Drawing Sheets

T
10a
W0
21'
45
20
32
21
110
14a
(20,W,10)
37
30
b
C
R
c
S
31
22
15
14
100
a
A
24
31
50
24
20
23
W
16
16
10
95
19
19
19
10
17
18
T2
40α
40
41
41
W
37
38
36

HYBRID FORMER FOR A PAPER MACHINE

BACKGROUND OF THE INvENTION

The present invention concerns a hybrid former for a paper machine, the former comprising a lower-wire loop which is jointly operative with the head box of the paper machine and which forms a first single-wire, preferably substantially horizontal dewatering zone in which water is removed from the web being formed by means of dewatering members placed inside the wire loop through the lower wire. Additionally, this former comprises an upper-wire unit which includes an upper-wire loop guided by guide and web-forming rolls, and forming, together with the run of the lower wire, a second twin-wire dewatering zone after the first dewatering zone. Furthermore, this former comprises a hollow-faced, first forming roll fitted inside the upper-wire loop at which the second, twin-wire dewatering zone begins and is curved upwardly over a certain sector of this forming roll. Additionally, a forming shoe is fitted inside the lower-wire loop after the forming roll and guides the second dewatering zone. The forming shoe is provided with a curved deck for guiding the lower-wire loop in particular, and has a center or centers of curvature on the side of the lower-wire loop.

It is known in the prior art that dewatering of a web that is being formed on a fourdrinier former of a fourdrinier paper machine takes place exclusively downwardly, whereby fines and fillers are removed from the web from the side of the wire due to the washing effect of either stationary dewatering members, e.g. foils, or revolving table rolls. This is the reason why a paper web produced by a fourdrinier machine is always anisotrophic with respect to properties of the two sides thereof, so that the upper face of the web is smoother and contains a larger amount of fines and fillers than the face that was situated against the wire which thus has a lower content of fines and fillers and in which, moreover, a so-called wire marking can be seen. Due to the above reasons, so-called twin-wire formers have been developed in which the forming of the web takes place for a significant part between two wires so that the two-sidedness of the web can be at least partially eliminated. Paper produced by means of such machines is also considered better, particularly with respect to printing qualities, than paper produced by means of fourdrinier machines.

In such prior-art twin-wire formers in which stationary dewatering members are not used, the formation is usually poor since it is impossible to produce pulsation of dewatering pressure which is ideal for improving the formation by means of revolving dewatering members. A further drawback has been that these prior-art formers have not included the possibility of controlling the proportion of quantities of dewatering taking place through the upper wire and through the lower wire. In several cases, operators of paper machines have expressed the need for such possibility of control to be provided.

In a manner known in the prior art with respect to twin-wire formers of paper machines, different types of so-called forming shoes are used as stationary dewatering elements, such shoes being most commonly composed of several ribs transverse to the direction of running of the wire. In addition to the dewatering effect, these ribs also produce pulsation in the partially formed web passing thereby between the two wires. By the effect of this pulsation, the fibers in the web are displaced relative to one another so that fiber agglomerations or flocks present in the web are decomposed to some extent. In such forming shoes, the guide or glide face placed against the wire is curved, and its structure is usually the same over the entire length of the shoe. It has also been possible to note that such a forming shoe operates optimally only within a quite limited speed range of the paper machine, and as a rule, with only a certain specific paper quality produced.

With twin-wire formers, a considerable proportion of the dewatering takes place within the area of the forming shoe. Thus, the forming shoe has considerable potential possibilities of affecting both the dewatering capacity and the web formation. It has, however, not been realized in the prior art how to make use of these possibilities, except to a limited extent. Moreover, it should be noted that the forming shoe acts as an element controlling the joint run of the wires, thereby affecting the stability of the runs of the wires for its part.

With respect to the prior art related to the present invention, reference is made to the Valmet Finnish Patent Application No. 771364 (filed Apr. 28, 1977), in which a method for the manufacture of multi-layer board and a web forming unit are described. As described therein, a forming shoe is used on the twin-wire part in which a length of the open and closed guide face is arranged to be adjustable by means of filler ribs. Thereby, a slot face on the forming shoe can be converted to a completely solid guide face. This forming shoe is expressly intended for the manufacture of multi-layer board.

Reference is also made to the Valmet Finnish Patent Applications Nos. 820742 (corresponding to U.S. Pat. No. 4,614,566) and 821531, in which a forming-shoe construction is described in the latter reference as consisting of two or more rib face components of different curve radii, and whose length proportions are adjustable relative to each other.

In recent years, modernization of existing fourdrinier machines has become common in which one upper-wire unit has most commonly been placed on the fourdrinier wire part jointly operative therewith, and within the area of which the dewatering can also be made to take place upwardly. Both increasing the dewatering capacity and improving the retention are aims or goals. Such wire parts are called hybrid formers. The wire parts of entirely new paper machines can also be designed of the hybrid type, right from the beginning.

As a rule, an increased dewatering capacity permits an increased running speed of a paper machine, or at least, if the running speed remains unchanged, permits a lowering of the consistency of the pulp fed out of the head box which has, in itself, favorable effects. In certain cases, by means of the upper-wire units noted above, older slow newsprint machines have been modernized into board machines, without increasing the running speed of the machines.

SUMMARY OF THE INVENTION

Accordingly, it is an object of the present invention to provide a dewatering arrangement applicable in hybrid formers, by means of which improved formation of a web is obtained.

It is also an object of the present invention to control the dewatering process by means of such a dewatering arrangement, so that it is possible to affect distribution of fillers and fines in the web.

It is an additional object of the present invention to provide a dewatering arrangement applicable in hybrid formers by means of which, within a twin-wire dewatering zone, improved support and stability of running are attained for the wires.

It is another object of the present invention to improve formation and to especially reduce streaks in a web, which are caused by folding due to unstable running of wires in a former.

It is a further object of the present invention to provide a dewatering member and arrangement to be used in a twin-wire part of a hybrid former, by which the wire part of the paper machine can be adjusted so as to operate optimally with respect to both dewatering capacity and web formation at different running speeds of the paper machine and when different paper qualities are manufactured.

These and other objects are attained by the present invention which is directed to a hybrid former for a paper machine, comprising a lower wire loop operative jointly with a head box of the paper machine and forming a first single-wire dewatering zone in which water is removed through the lower wire from a web being formed by at least one dewatering member situated inside the lower wire loop, and an upper wire unit including an upper wire loop guided by guide rolls and a web-forming roll. The upper wire loop forms, after the first dewatering zone, a second twin-wire dewatering zone together with a run of the lower wire. The web-forming roll is fitted inside the upper wire loop at a location where the second twin-wire dewatering zone begins. This second twin-wire dewatering zone is curved upwardly over a sector of the forming roll.

Furthermore a forming shoe is fitted inside the lower wire loop and is provided with a curved deck for guiding the lower wire. The curved deck has a center of curvature inside the lower wire loop.

Deflector units are fitted both inside the lower wire loop and inside the upper wire loop, between the forming roll and the forming shoe along the twin-wire dewatering zone. This produces impulses which act on the web being formed from both sides, and are sufficiently strong to improve formation.

Preferably, the first single-wire dewatering zone is substantially horizontal, with the forming roll being hollow-faced, and the second twin-wire dewatering zone having a substantially straight and upwardly inclined run between the forming roll and the forming shoe, along which the deflector units are fitted. The deflector units themselves are also preferably adjustable.

With respect to the theory of dewatering taking place in a twin-wire curved forming zone, reference is made to the following papers:

*Papper och Tra* 1972, No. 4, pp. 137–146, Jouni Koskimies, Jorma Perkinen, Heikki Puolakka, Eero Schulz, Bjorn Wahlstrom, "A Drainage Model for the Forming Zone of a Two-wire Former" and *Pulp and Paper Magazine of Canada*, Vol. 74, No. 2 (February 1973), pp. 72–77, E. G. Hauptmann and J. Mardon, "The Hydrodymanics of Curved Wire Formers".

The dewatering arrangement in accordance with the present invention is principally characterized by deflector units being fitted both inside the lower-wire loop and inside the upper-wire loop on the twin-wire dewatering zone between the first forming roll and the forming shoe, this run of the twin-wire dewatering zone being substantially straight and upwardly inclined. By means of these deflector units, sufficiently strong impulses improving the formation of a web are produced, these impulses being preferably adjustable and which act upon the web that is being formed from both sides thereof.

The advantages provided by the present invention will be described in detail below.

Due to the deflector dewatering member and arrangement, better formation is obtained for the web than by means of a conventional forming shoe. Dewatering adjustable with respect to its quantities and proportions is achieved by means of adjustment of the ribs included in the deflector part of the dewatering member.

By means of choice and adjustability of the types and numbers of deflector ribs, it is possible to control the dewatering capacity and even the dewatering direction. This makes it possible to control the dewatering process in the first, single-wire dewatering zone of the hybrid former to make the dewatering slower and, at the same time, more gentle, so that a dewatering proportion of appropriate magnitude can still take place in the second, twin-wire dewatering zone where the ultimate formation of the web is achieved.

The deflector arrangement in accordance with the present invention is situated ahead of the forming-shoe part proper, where adjustable suction is preferably used.

BRIEF DESCRIPTION OF THE DRAWINGS

The present invention will be described in greater detail below with reference to certain exemplary embodiments thereof illustrated in the accompanying drawings, and to which the present invention is not intended to be strictly confined. In the drawings.

DESCRIPTION OF THE PREFERRED EMBODIMENTS

Figure 1:
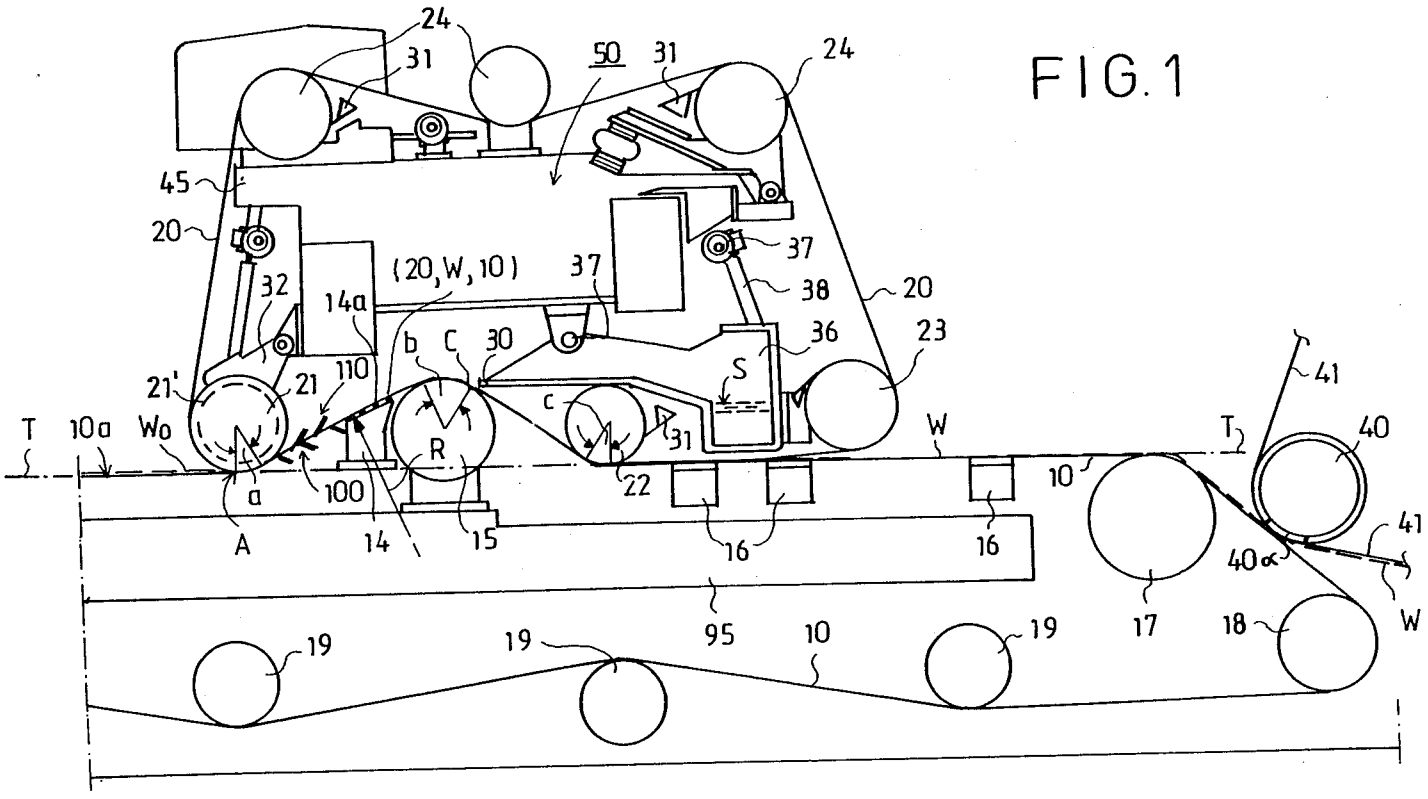
FIG. 1 is a schematic side view of a hybrid former which has been prepared by modernization of an existing fourdrinier wire part, and in which the dewatering arrangement in accordance with the present invention has been applied.
Figure 2:
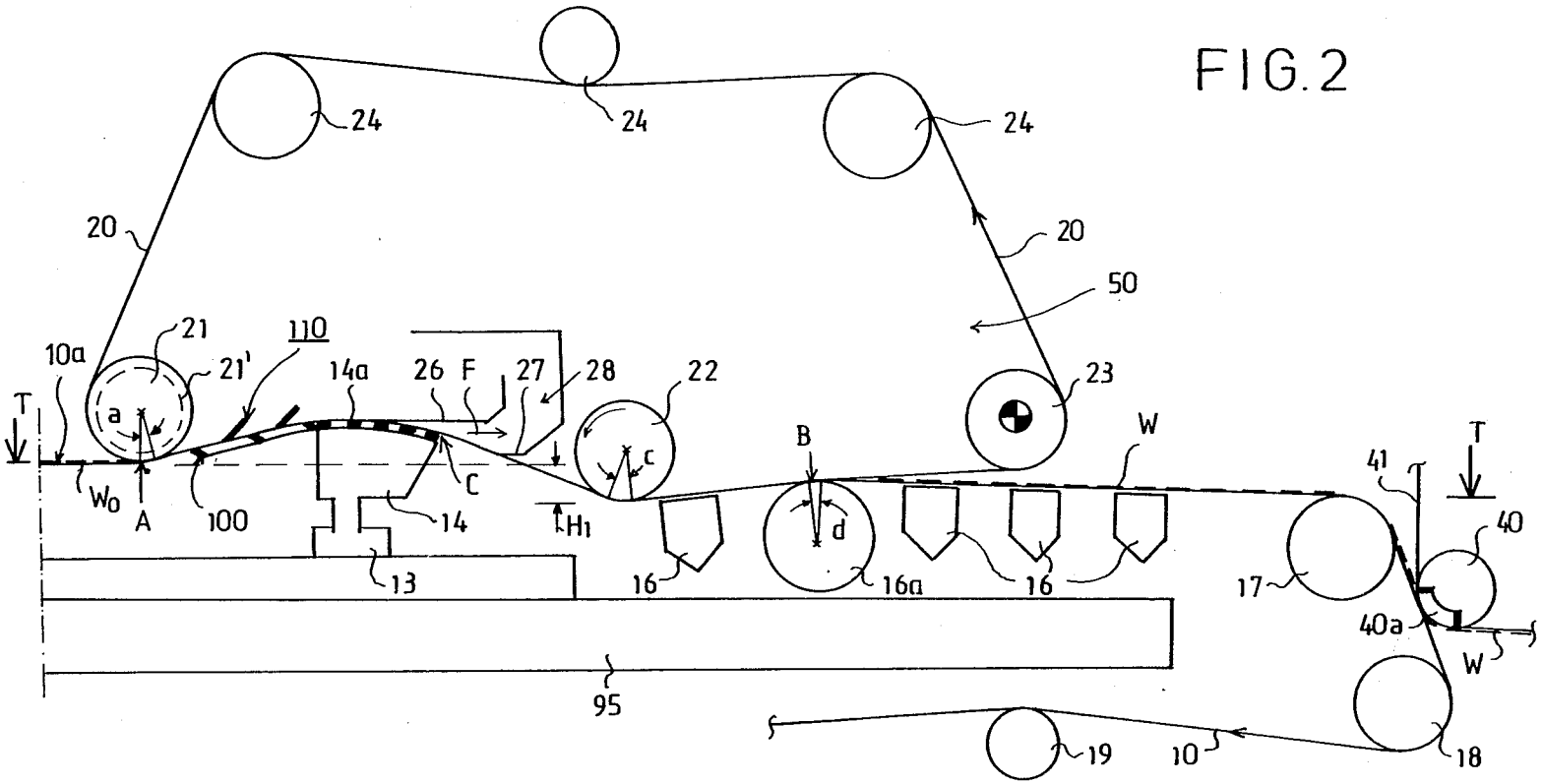
FIG. 2 is a second exemplary embodiment of the present invention in a manner corresponding to FIG. 1, and illustrated more schematically.

As shown in FIGS. 1 and 2, the fourdrinier wire part of a fourdrinier paper machine has been provided with an upper-wire unit 50 and thereby converted to a hybrid former. The wire plane of the original fourdrinier wire part is denoted by reference T—T. The hybrid former includes a frame 95 of the previous older wire part, dry suction boxes 16, wire suction roll 17 and drive roll 18, as well as guide rolls 19 guiding the lower run of the wire 10, all of which were included in the original wire part.

When the present invention is applied to hybrid formers in accordance with the figures, a lower deflector unit 100 is fitted in accordance with the present invention on a frame part supported from outside the wire part or on the older frame part 95.

The upper-wire unit 50 includes the frame part 45 illustrated in FIG. 1, to which the different parts, and also an upper deflector unit 110 are attached. The running of the upper-wire loop 20 is guided, starting from the beginning A of the twin-wire section, by a preferably hollow-faced 21, first forming roll 21, and then by the dewatering elements 100 and 110 in accordance with the invention and by a first leading roll 22 situated inside the loop 20 of the upper wire. In the area or at the proximity of this roll 22, the run of the twin-wire section (20, W, 10) joins the original plane T—T of the lower wire 10, as illustrated in FIG. 1. The twin-wire dewatering zone terminates before the drive roll 23 of the upper wire 20. The upper guide rolls of the upper wire 20 are denoted by reference numeral 24. The rolls 22, 23 and 24 are provided with doctors 31. The roll 21 is also provided with cleaning means (not illustrated) and water-collecting means known in and of themselves.

The hybrid former obtained as a result of the modernization is, before the twin-wire section, provided with a first single-wire dewatering zone 10*a* which is formed by the original fourdrinier wire and in which the dewatering takes place, preferably by means of the dewatering members included in the original fourdrinier wire part such as forming board and foils (not illustrated). In the first dewatering zone 10*a*, the dewatering takes place downwardly through the lower wire 10, but preferably relatively gently so that possibilities for adequate retention are retained and an adequate proportion is left over for dewatering taking place upwardly with a view to good formation.

After the line of departure C from the forming members 100, 110, 14, 15, there is a downwardly inclined straight joint run of the wires 10 and 20 down to the roll 22, on which the joint run of the wires 10 and 20 is directed slightly upwardly, finally joining the original plane T—T of the lower wire 10.

The web W is detached from the lower wire 10 on the downwardly inclined run between the rolls 17 and 18 by the effect of the suction zone 40 $\alpha$ of the pick-up roll 40, being transferred onto the pick-up fabric 41 which transfers the web W further into the press section (not illustrated).

The dissimilar features of the structures illustrated in FIGS. 1 and 2 will be described below. As shown in FIG. 1, a forming shoe 14 provided with a ribbed deck 14*a*, within whose area the joint run of the wires 10 and 20 passes at all times upwardly with a relatively large curve radius R which is of an order of R= about 2.5 to 5 m, is provided after the deflector units 100 and 110. Furthermore, according to FIG. 1, a very short straight run of the wires 10, 20 follows after the curved ribbed deck 14*a* of the forming shoe 14, after which there is a forming roll 15 on whose sector b the joint run of the wires 10 and 20 is turned downwardly. After this, there is the smooth-faced roll 22 situated inside the loop of the upper wire 20, and within whose sector c the joint run of the wires is turned and joins the plane T—T of the lower wire 10.

FIG. 1 illustrates a water removing trough in which a front edge 30 of a bottom plane is situated at the proximity of the sector b of the roll 15. The water removing trough 36 is attached to the frame 45 by means of horizontal shafts 37, and can be pivoted by means of a screw transmission 37 through rods 38 as illustrated. The water drained through the upper wire 20 is passed to the side of the paper machine by way of the water removing trough 36. The water level in the trough 36 is denoted by S.

The hybrid former illustrated in FIG. 2 differs from the former illustrated in FIG. 1 with respect to the twin-wire dewatering zone following after the deflector units 100 and 110 in a direction of web W travel. According to FIG. 2, the run of the wires 10, 20 is substantially straight after the deflector units 100 and 110 and the run of the wires 10, 20 is curved within the area of the deflectors 100 and 110. The wires 10, 20 are guided by a curved ribbed deck 14*a* on the forming shoe 14 which is connected to a suction source 13, e.g. a suction leg, and becomes a downwardly inclined run. This downwardly inclined run is so steep or so long that the twin-wire dewatering zone extends on a sector c of the roll 22 by a height difference $H_1$ below the plane T—T.

By means of this arrangement, space is allowed for the particular dewatering trough 28 illustrated in FIG. 2, this trough including walls 26 and 27 fitted proximate to the downwardly inclined run of the wires 10 and 20. The water drained through the upper wire 20 is cast between these walls 26 and 27 by the effect of dynamic energy in the direction of arrow F and is removed because of this and due to the difference in height $H_1$, without a necessity to use any particular suction devices such as AUTO-SLICE (TM) devices known in the prior art. This makes the construction simpler and less expensive.

According to FIG. 2, the joint run of the wires 10, 20 is turned upwardly on the sector c of the roll 22, and becomes a gently upwardly-inclined run, after which a guide roll 16*a* follows on whose sector d the twin-wire 10, 20 forming zone joins the plane T—T of the lower wire 10, and on which sector, at the area of the line B, the upper wire 20 departs from the web W which follows along with the lower wire 10.

An essential constituent of the combination of the invention includes the deflector units 100 and 110 which guide the joint run of the wires 10 and 20 upwardly from the sector a of the forming roll 21 up to the inlet edge of the ribbed deck 14*a* of the forming shoe 14.

Figure 3:
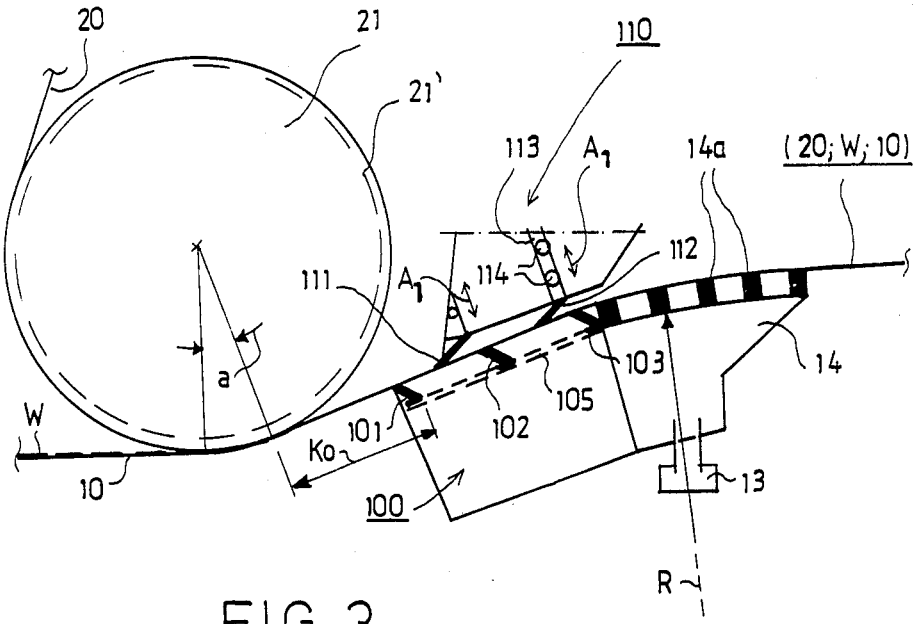
FIG. 3 is an overall view of the principal parts and the location of the dewatering arrangement in accordance with the present invention in the second, twin-wire dewatering zone shown in FIG. 1.
Figure 4:
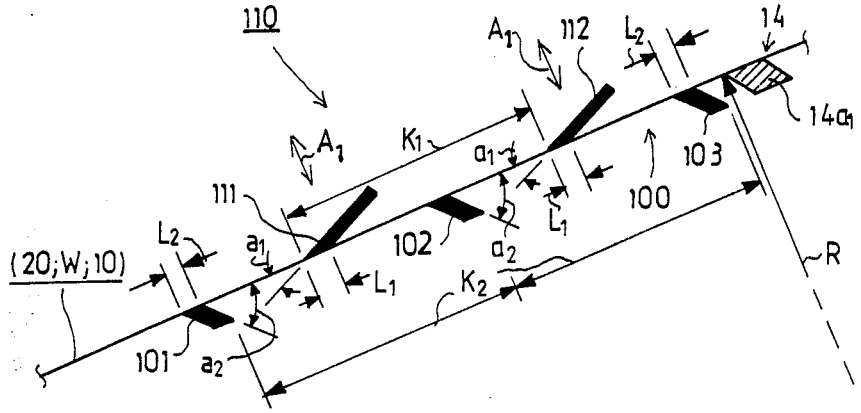
FIG. 4 is a more detailed view of the deflector part of the web formation and dewatering arrangement illustrated in FIG. 3.

FIGS. 3 and 4 illustrate more detailed views, principally of the exemplary embodiment illustrated in FIG. 1. According to FIGS. 3 and 4, there is a deflector unit 00 inside the loop of the lower wire 10, which includes subsequent deflectors 101, 102 and 103 with a mutual spacing $K_1$, of which the first deflector 101 is situated close to the sector a of the forming roll 21 (at the distance $K_0$ therefrom) and the last deflector 103 is placed near the first rib 14*a*$_1$ of the forming shoe 14 (FIG. 4). Correspondingly, there is a deflector unit 110 inside the loop of the upper wire 20, which includes two subsequent deflectors 111 and 112, with substantially planar front faces thereof situated against the inner face of the upper wire 20. The substantially planar front faces of the lower deflectors or ribs 101–103 are also situated against the inner face of the lower wire 10.

The lower deflector unit 100 is preferably stationary, but its deflectors 101, 102 and 103 may also be arranged to be displaceable in guides 105 or equivalent, principally in the direction of running of the wires 10 and 20. The upper deflector unit 110 is arranged to be adjustable either as a whole or separately (i.e. in parts) in the direction of the arrows $A_1$, i.e. in a direction substantially perpendicular to the plane of the wires 10 and 20, so that the front faces of the deflectors 111 and 112 guide the run of the wires together with the deflectors 101 and 102 in the unit 100, in a manner such that a joint run that is straight or has a very low meandering wave height, is obtained for the wires 10, 20, by means of which run strong impulses are produced in the web W at both of its sides.

By the effect of these impulses, the formation of the web W is improved. By adjusting the position of the upper deflectors 111 and 112 in the direction $A_1$, it is possible to adjust the magnitude of these impulses to an optimal level in consideration of the quality of the paper to be manufactured, of the running speed of the machine, and of other circumstances or comparable perameters. Instead of adjusting the position of the entire upper deflector unit 110, it is possible to attach the deflectors or ribs 111 and 112 to a frame part which is arranged to be adjustable in the direction of the arrows $A_1$ by means of guides 113, 114 in connection with the frame part of the deflector unit 110. In this manner, if necessary, the first and the second upper deflectors 111 and 112 can be adjusted independently from one another. In certain applications, it is also possible to arrange the lower deflectors 101, 102 and/or 103 to be adjustable with respect to the position thereof in a direction substantially perpendicular to the plane of the wires 10 and 20.

The mutual spacing of the upper deflectors 111 and 112 is denoted by $K_1$. Correspondingly, the mutual spacing of the lower deflectors 101, 102 and 103 is denoted by $K_2$. In the present invention, $K_o \approx K_1 \approx K_2 =$ about 150–300 mm, preferably $K_o \approx K_1 \approx K_2 =$ about 200–250 mm.

The length of the front face of the upper deflectors 111, 112 is denoted by $L_2$, and correspondingly the appropriate length of the front face of the lower deflectors 101, 102, 103 is denoted by $L_2$. In the present invention, as a rule $L_1 \approx L_2 =$ about 10–40 mm, preferably $L_1 \approx L_2 = 20$–30 mm.

The blade angle or deflector angle of the upper deflectors 111, 112 is denoted by $a_1$. This angle $a_1 =$ about 15°–40°, preferably $a_1 =$ about 20°–25°. In a corresponding manner, the deflector angle of the lower deflectors 101, 102, 103 is denoted by $a_2$. Generally, it can be ascertained that it is advantageous that $a_1 < a_2$, and $a_2 =$ about 30°–60°, preferably $a_2 =$ about 40°–45°. The angles $a_1$ of different deflectors 111 and 112 may be different from one another. In a corresponding manner, the angle $a_2$ of different deflectors 101, 102, 103 may be, to some extent, different from one another.

The locations of the deflectors are preferably such that the blade edges of the deflectors 111 and 112 situated inside the upper-wire loop 20 are placed about halfway or midway between the deflectors 101, 102, 103 situated inside the lower-wire loop 10, as illustrated in FIG. 4. The planes of the front faces of the deflectors are substantially in the same plane as a tangential plane that contacts the face of the forming roll 21 on the one hand, and the first rib 14$a_1$ of the forming shoe 14 on the other hand. In other words, each deflector unit 100, 110 includes at least two deflector ribs 101, 102, 103, 111, 112 having planar faces contacting against the inner surfaces of the wires 10, 20, and situated substantially in an imaginary joint tangential plane passing between the forming roll 21 preceding the deflector units 100, 110, and the first forming rib 14$a_1$ in the rib deck 14*a* of the forming shoe 14.

The front faces of the deflectors may also be situated slightly apart from the inner faces of the wires 10 and 20 to avoid wear on the wires. The deflector ribs are preferably formed of a ceramic material or of any other corresponding wear-resistant material.

The results of comparisons made in trial runs with the invention test paper machine will be given below. In the following table, the discharge opening (mm) of the head box is given on the first line, with the Beta formation with a former geometry in accordance with FIG. 1 without the deflector units 100 and 110 being given on the second line, and the corresponding Beta formation figures when using deflectors fitted and dimensioned in accordance with FIG. 4 being given on the third line.

TABLE

| Discharge opening (mm) | 12 | 14 | 16 |
|---|---|---|---|
| Std. shoe | 3.50 | 3.28 | — |
| Defl. + std. shoe | 3.16 | 2.94 | 3.03 |

The preceding description of the present invention is merely exemplary, and is not intended to limit the scope thereof in any way.

We claim:

1. Hybrid former for a paper machine, said former comprising a lower wire loop operative jointly with a head box of the paper machine and forming a first single-wire dewatering zone in which water is removed through the lower wire from a web being formed by at least one dewatering member situated inside the lower wire loop, and an upper wire unit including an upper wire loop guided by guide rolls and a web-forming roll, said upper wire loop forming, after the first dewatering zone, a second twin-wire dewatering zone together with a run of the lower wire, the web-forming roll being fitted inside the upper wire loop at a location where the second twin-wire dewatering zone begins and the second twin-wire dewatering zone is curved upwardly over a sector of the forming roll, a forming shoe being fitted inside the lower wire loop and being provided with a curved deck guiding the lower wire and having a center of curvature inside the lower wire loop, wherein deflector units are fitted both inside the lower wire loop and inside the upper wire loop between the forming roll and forming shoe along a continuously upwardly directed run of the twin-wire dewatering zone from the forming roll to an inlet edge of the deck of the forming shoe, to produce impulses which act on the web being formed from both sides and are sufficiently strong to improve web formation, wherein the first single-wire dewatering zone is substantially horizontal, the forming roll is hollow-faced, and the second twin-wire dewatering zone run is substantially straight and upwardly inclined between the forming roll and forming shoe along which said deflector units are fitted, additionally comprising a second forming roll situated inside the lower wire loop and after the forming shoe in a direction of travel, and positioned to curve the twin wire zone downwardly over a sector thereof, a downwardly inclined run of the second twin-wire zone after the second forming roll, and the twin-wire zone being curved upwardly after the downwardly inclined run about a forming or guide roll to a plane substantially equal to the first substantially horizontal, single wire portion.

2. The combination of claim 1, wherein said second forming roll is smooth-faced.

3. The combination of claim 1, additionally comprising means for adjusting said deflector units.

4. The combination of claim 1, wherein each said deflector unit comprises at least two deflector ribs having substantially planar faces situated to contact the respective upper and lower wires.

5. The combination of claim 4, wherein said substantially planar faces are situated substantially in a tangential plane contacting a face of the forming roll and a first rib in the deck of the forming shoe.

6. The combination of claim 4, additionally comprising means for adjusting said deflector ribs in at least one of said deflector units at least in a direction substantially perpendicular to a plane of the wires at the location of the deflectors, for controlling magnitude of the impulses directed at the web.

7. The combination of claim 6, wherein said lower deflector unit in the lower wire loop is fixed and said adjusting means comprise at least one of said deflector ribs in said lower units being adjustable over said substantially perpendicular direction.

8. The combination of claim 7, wherein said lower deflector unit comprises three deflector ribs along the second, twin-wire zone between the forming roll and shoe, with a last one of said ribs in a direction of web travel being situated proximate to the first rib of the forming shoe, and said upper deflector unit inside the upper wire loop comprises two deflector ribs, each situated along the second, twin-wire zone between respective ribs of said lower deflector unit in the web travel direction.

9. The combination of claim 8, wherein each said deflector rib of said upper deflector unit is positioned substantially midway between said respective deflector ribs of said lower deflector unit.

10. The combination of claim 4, wherein distance between a first rib of said deflector unit in the lower wire loop in a direction of web travel and a point where the wires separate from the forming roll is substantially equal to mutual distance between said ribs of said lower deflector unit.

11. The combination of claim 5, wherein said ribs of said upper deflector unit are positioned at a deflector angle with respect to said tangential plane of about 15° to 40°.

12. The combination of claim 11, wherein said angle is about 20° to 25°.

13. The combination of claim 5, herein said ribs of said lower deflector unit are positioned at a deflector angle with respect to said tangential plane of about 30° to 60°.

14. The combination of claim 13, wherein said angle is about 40° to 25°.

15. The combination of claim 4, wherein length of said faces of said upper and lower deflector unit ribs in a direction of web travel is about 10 mm to 40 mm.

16. The combination of claim 15, wherein said length is about 20 to 30 mm.

17. The combination of claim 10, wherein said mutual distance between said ribs of said lower deflector unit, and also mutual distance between said ribs of said upper deflector unit are about 150 to 300 mm.

18. The combination of claim 17, wherein said mutual distances are about 200 to 250 mm.

19. The combination of claim 5, wherein said deflector ribs are inclined with respect to said tangential plane, and in a direction of web travel.

20. The combination of claim 5, wherein said deflector units are structured and arranged to control the magnitude of the impulses up to the inlet edge of the ribbed forming shoe deck.

21. The combination of claim 6, wherein said adjusting means comprise said ribs of said upper deflector unit being adjustable.

* * * * *